US010046953B2

(12) United States Patent
Schneider et al.

(10) Patent No.: US 10,046,953 B2
(45) Date of Patent: Aug. 14, 2018

(54) METHODS FOR CONTROLLING A DRIVE OF A CRANE

(75) Inventors: Klaus Schneider, Hergatz (DE); Oliver Sawodny, Stuttgart (DE); Sebastian Kuechler, Boeblingen (DE)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 1728 days.

(21) Appl. No.: 12/832,475

(22) Filed: Jul. 8, 2010

(65) Prior Publication Data

US 2011/0006023 A1 Jan. 13, 2011

(30) Foreign Application Priority Data

Jul. 8, 2009 (DE) ..... 10 2009 032 270

(51) Int. Cl.
*B66C 13/06* (2006.01)

(52) U.S. Cl.
CPC ..... *B66C 13/063* (2013.01)

(58) Field of Classification Search
CPC ..... B66C 13/46; B66C 13/08; B66C 13/06; B66C 2700/082; B63B 27/10
USPC .... 701/13, 63, 305, 50, 36, 34.4, 32.9, 31.4, 701/22, 123; 60/466, 444, 413; 37/348; 212/275, 273, 270
See application file for complete search history.

(56) References Cited

U.S. PATENT DOCUMENTS

| | | | | |
|---|---|---|---|---|
| 5,878,896 | A * | 3/1999 | Eudier et al. | 212/270 |
| 5,908,122 | A * | 6/1999 | Robinett et al. | 212/275 |
| 6,496,765 | B1 * | 12/2002 | Robinett et al. | 701/50 |
| 7,367,464 | B1 * | 5/2008 | Agostini et al. | 212/308 |
| 2004/0164041 | A1 * | 8/2004 | Sawodny et al. | 212/273 |
| 2007/0050115 | A1 * | 3/2007 | Discenzo et al. | 701/50 |
| 2008/0017601 | A1 * | 1/2008 | Neupert et al. | 212/270 |
| 2008/0065298 | A1 * | 3/2008 | Kawaguchi | 701/50 |

FOREIGN PATENT DOCUMENTS

| | | |
|---|---|---|
| DE | 3719897 | 12/1987 |
| DE | 260052 | 9/1988 |
| DE | 4025749 | 2/1992 |
| DE | 4130970 | 4/1992 |
| DE | 19612570 | 10/1997 |
| DE | 60019794 | 3/2006 |
| DE | 102004052616 | 5/2006 |
| DE | 102006043492 | 3/2008 |
| DE | 102007039408 | 11/2008 |
| EP | 1652810 | 5/2006 |
| FR | 2600316 | 12/1987 |

* cited by examiner

*Primary Examiner* — Jelani A Smith
(74) *Attorney, Agent, or Firm* — Dilworth & Barrese, LLP.; Michael J. Musella, Esq.

(57) ABSTRACT

The present invention comprises a method for the control of a drive of a crane, in particular of a slewing gear and/or of a luffing mechanism, wherein a desired movement of the boom tip serves as an input value on the basis of which a control parameter for the control of the drive is calculated, characterized in that the oscillation dynamics of the system comprising the drive and the crane structure are taken into account in the calculation of the control parameter to reduce natural oscillations. The present invention furthermore comprises a method for the control of a hoisting gear of a crane, wherein a desired hoisting movement of the load serves as an input value on the basis of which a control parameter for the control of the drive is calculated.

5 Claims, 3 Drawing Sheets

METHODS FOR CONTROLLING A DRIVE OF A CRANE

BACKGROUND OF THE INVENTION

The present invention relates to methods for the controlling of drives of a crane. The present invention in particular relates in this respect to a method for the control of a crane, in particular of a slewing gear and/or of a luffing mechanism, wherein a desired movement of the boom tip serves as an input value on the basis of which a control parameter for the control of the drive is calculated. The present invention furthermore relates to a method for the control of a hoisting gear of a crane in which a desired hoisting movement of the load serves as an input value on the basis of which a control parameter for the control of the drive is calculated. The drive of the crane in accordance with the invention can in particular be a hydraulic drive. The use of an electric drive is, however, likewise possible. In this respect, the luffing mechanism can e.g. be realized via a hydraulic cylinder or via a retraction mechanism.

In known methods for the control of drives of a crane, an operator in this respect sets the desired movement of the boom tip, and thus the desired movement of the load in the horizontal direction, by means of hand levers, and a control parameter for the control of these drives is calculated from it on the basis of the kinematics of the slewing gear and the luffing mechanism. The operator furthermore presets the desired hoisting movement of the load by means of hand levers and a control parameter for the control of the hoisting mechanism is calculated from it.

Methods for load swing damping are furthermore known in which, instead of the movement of the boom tip, a desired movement of the load serves as an input value to calculate a control parameter for the control of the drive. A physical model of the movement of the load suspended at the load rope can in this respect e.g. be used in dependence on the movement of the drive to avoid spherical swing oscillations of the load by a corresponding control of the drives.

The known methods for the control of cranes can, however, produce substantial strains on the crane structure.

SUMMARY OF THE INVENTION

It is therefore the object of the present invention to provide a method for the control of a drive of a crane which reduces such strains on the crane structure.

This object is solved in accordance with the invention by a method in accordance with the description herein. In the method in accordance with the invention for the control of a drive of a crane, in particular of a slewing gear and/or of a luffing mechanism, a desired movement of the boom tip serves as an input value on the basis of which a control parameter for the control of the drive is calculated. Provision is made in this respect in accordance with the invention that on the calculation of the control parameter, the internal oscillation dynamics of the system of drive and crane structure are taken into account to damp natural oscillations. The drive can in this respect be a hydraulic drive. The use of an electric drive is, however, likewise possible.

In this respect, the inventors of the present invention have found that the natural oscillations can exert great strain on the crane structure and on the drives. Natural oscillations can, in contrast, be damped and advantageously largely avoided by taking account of the internal oscillation dynamics of the drive and of the crane structure in the calculation of the control parameter. This has the advantage, on the one hand, that the boom tip follows the preset desired movement exactly without oscillating. On the other hand, the crane structure and the drives are not under any strain by the natural oscillations. The damping of the natural oscillations in accordance with the invention therefore has a positive effect on the service life and on the maintenance costs.

The method in accordance with the invention is in this respect advantageously used in cranes in which a boom is pivotally connected to a tower in a manner luffable about a horizontal luffing axis. The boom can in this respect be luffed up and down in the luffing plane by a boom cylinder arranged between the tower and the boom. It is equally possible to use a retraction mechanism which moves the boom via a rope arrangement in the luffing plane as the luffing mechanism. The tower is in turn rotatable about a vertical axis via a slewing gear in particular in the form of a hydraulic motor. The tower can in this respect be arranged on an undercarriage which is movable via a traveling gear.

The method in accordance with the invention can be used with any desired cranes, for example with harbor cranes and in particular with mobile harbor cranes.

The control of the drive advantageously takes place in accordance with the invention on the basis of a physical model which describes the movement of the crane tip in dependence on the control parameter. The use of a physical model in this respect enables a fast adaptation of the control method to different cranes. In this respect, the oscillation behavior does not first have to be determined laboriously by measurements, but can be described with reference to the physical model. In addition, the physical model allows a realistic description of the oscillation dynamics of the crane structure so that all the relevant natural oscillations can be damped. For this purpose, the physical model does not only describe the kinetics of the drives and of the crane structure, but also the oscillation dynamics of the drive and of the crane structure.

The calculation of the control parameter advantageously takes place on the basis of an inversion of the physical model which describes the movement of the crane tip in dependence on the control parameter. The control parameter is thus obtained by the inversion in dependence on the desired movement of the boom tip.

The model which describes the movement of the crane tip in dependence on the control parameter is preferably non-linear. This has the result of a higher precision in the control since the decisive effects which result in natural oscillations of the crane structure are non-linear.

If a hydraulic drive is used, the model thus advantageously takes account of the oscillation dynamics of the drive due to the compressibility of the hydraulic fluid. This compressibility in this respect results in oscillations of the crane structure which can exert substantial strain on it. These vibrations can be damped by taking account of the compressibility of the hydraulic fluid.

The method in accordance with the invention in this respect advantageously serves the control of the luffing cylinder used as the luffing mechanism, with the kinematics of the pivotal connection of the cylinder and the mass and the inertia of the boom of the crane being taken into the calculation of the control parameter. Natural oscillations of the boom in the luffing plane can hereby be damped.

Alternatively to the hydraulic cylinder, a retraction mechanism can be used as the luffing mechanism, with the kinematics and/or dynamics of the retraction rope arrangement as well as the mass and the inertia of the boom of the crane advantageously being taken into the calculation of the control parameter.

Alternatively or additionally, the method in accordance with the invention serves the control of the stewing gear, with the moment of inertia of the boom of the crane being taken into the model. Natural oscillations of the crane structure about the vertical axis of rotation can hereby be damped.

The oscillation damping advantageously takes place by way of the pre-control. Cost-intensive sensors which would otherwise have to be used can hereby be saved. In addition, the pre-control allows an effective reduction in the natural oscillations without being limited to a specific frequency range due to the response speed of the drives as with a regulation with a closed regulation loop.

In this respect, the position, the speed, the acceleration and/or the jolt of the boom tip advantageously serve as desired parameters of the pre-control. In this respect, in particular at least two of these values advantageously serve as desired parameters. Further advantageously in this respect, in addition to the position, one of the further values is used as a desired parameter. Further advantageously, all of these values are used as desired parameters of the pre-control.

Further advantageously, a desired trajectory of the boom tip is generated as an input value of the control from inputs of an operator and/or of an automation system. A desired trajectory of the boom tip is thus generated from the inputs input by an operator by means of hand levers and/or from the signals of an automation system. The control method in accordance with the invention now provides that the drives of the crane are controlled such that the boom tip follows this desired trajectory and natural oscillations of the crane are avoided.

The method in accordance with the invention can in this respect be used together with load swing damping, but also completely without any load swing damping. Known methods for load swing damping in this respect concentrate solely on the avoidance of sway oscillations of the load, which could in part even result in an increase in the natural oscillations of the crane structure and thus in a stronger strain than a control without load swing damping. In contrast, the present invention damps the natural oscillations of the crane structure and thus spares the crane structure.

Provision can be made in this respect that possible spherical sway oscillations of the load do not enter into the control as a measurement parameter. Complex measurement apparatus for the measurement of the rope angle can therefore be dispensed with.

Possible spherical sway oscillations of the load can furthermore remain out of consideration on the control of the drive. The method in accordance with the invention can hereby also be used with simpler crane controls without load swing damping to spare the crane structure.

The method in accordance with the invention can, however, also be used in crane controls with load swing damping. The method is then implemented so that first the load movement serves as a desired parameter from which a desired movement of the boom tip is generated. This desired movement of the boom tip then serves as an input value of the method in accordance with the invention. A damping of the natural oscillations of the crane structure can also be achieved with methods with load swing damping by this two-stage approach. Known methods for load swing damping are, in contrast, directed solely to avoid oscillations of the load and can hereby even further amplify the natural oscillations of the crane structure.

The previously presented method in this respect preferably served the control of a slewing gear and/or of a luffing mechanism of a crane. It can, however, also be used to control the hoisting gear of a crane. The oscillation dynamics of the hoisting gear can in this respect in particular be taken into account on the basis of the compressibility of the hydraulic fluid.

In the control of the hoisting gear, however, the desired hoisting movement of the load advantageously serves as an input value on the basis of which a control parameter is calculated for the control of the drive.

It is therefore the object of the present invention likewise to enable a sparing of the structure on the control of the hoisting gear of a crane.

This object is achieved in accordance with the invention by a method in accordance with claim 10. In this respect, a method for the control of a hoisting gear of a crane is provided in which a desired hoisting movement of the load serves as an input value on the basis of which a control parameter for the control of the drive is calculated. Provision is made in accordance with the invention in this respect that the oscillation dynamics of the system comprising hoisting gear, rope and load in the rope direction are taken into account in the calculation of the control parameter to damp natural oscillations. The inventors of the present invention have in this respect recognized that the oscillation dynamics of the system comprising hoisting gear, rope and load can result in oscillations of the load or of the crane structure which can exert substantial strain both on the load rope and on the boom. In accordance with the invention, these oscillation dynamics are now therefore taken into account to avoid natural oscillations of the load and/or of the hoisting gear. The hoisting gear can in this respect be driven hydraulically and/or electrically.

This method is also advantageously used in cranes in which a boom is pivotally connected to a tower in a manner luffable about a horizontal luffing axis. The load rope is in this respect advantageously guided by a winch at the tower base over one or more pulley blocks at the tower tip to one or more pulley blocks at the boom tip.

In accordance with the method in accordance with the invention, the oscillation dynamics of the hoisting system are advantageously taken into account in oscillation reduction operation while possible movements of the support region on which the crane structure is supported are not taken into account in the control of the hoisting gear. The control therefore starts from a fixed-position support region in oscillation reduction operation. The control in accordance with the invention therefore only has to take oscillations into account which arise due to the hoist rope and/or the hoisting gear and/or the crane structure. Movements of the support region such as e.g. arise with a floating crane due to wave movement, in contrast, remain out of consideration in oscillation reduction operation. The crane control can thus be designed substantially easier.

The method in accordance with the invention can in this respect be used in a crane whose crane structure is actually supported on a fixed-position support region, in particular on the ground, during the hoisting. The crane control in accordance with the invention can, however, also be used with a floating crane, but does not take the movements of the floating body into account in oscillation reduction operation. If the crane control has an operating mode with an active swell sequence, the oscillation reduction operation thus takes place accordingly without any simultaneous active swell sequence operation.

Further advantageously, the method in accordance with the invention is used with transportable and/or mobile cranes. The crane in this respect advantageously has support means via which it can be supported at different hoisting locations. Further advantageously, the method is used with harbor cranes, in particular with mobile harbor cranes, with crawler-mounted cranes, with mobile cranes, etc.

The oscillation dynamics of the hoisting system due to the stretchability of the hoisting rope is advantageously taken into account in the calculation of the control parameter. The stretchability of the hoisting rope results in a stretching oscillation of the rope in the rope direction which is damped in accordance with the invention by a corresponding control of the hoisting gear. In this respect, the oscillation dynamics of the rope are advantageously taken into account with a load freely suspended in the air.

The hoisting gear of the crane in accordance with the invention can be hydraulically driven in this respect. Alternatively, a drive is also possible via an electric motor.

If a hydraulically driven hoisting gear is used, the oscillation dynamics of the hoisting gear due to the compressibility of the hydraulic fluid are further advantageously taken into account in the calculation of the control parameter. Those natural oscillations are thus also taken into account which arise due to the compressibility of the hydraulic fluid which is exerted on the drive of the hoisting gear.

In this respect, the variable rope length of the hoist rope is advantageously taken into account in the calculation of the control parameter. The method in accordance with the invention for the control of the hoisting gear thus takes oscillations of the load suspended at the hoist rope into account which are caused due to stretchability of the hoist rope dependent on the rope length of the hoist rope. Material constants of the hoist rope which influence its stretchability are furthermore advantageously taken into the calculation. The rope length is in this respect advantageously determined with reference to the position of the hoisting gear.

Further advantageously, the weight of the load suspended at the load rope is taken into the calculation of the control parameter. This weight of the load is advantageously measured in this process and is taken into the control process as a measured value.

The control of the hoisting gear is in this respect based on a physical model of the crane which describes the hoist movement of the load in dependence on the control parameter of the hoisting gear. As already presented, such a physical model allows a fast adaptation to new crane types. In addition, a more exact and better oscillation damping is hereby made possible. In this respect, the model also describes, in addition to the kinematics, the oscillation dynamics due to the stretchability of the hoist rope and/or due to the compressibility of the hydraulic fluid. In this respect, the model advantageously assumes a fixed-position support region of the crane.

The control of the hoisting gear is in this respect advantageously based on the inversion of the physical model. This inversion enables an exact control of the drive. The physical model in this respect initially describes the movement of the load in dependence on the control parameter. The control parameter is therefore obtained in dependence on the desired hoist movement by the inversion.

As already presented with respect to the control of the luffing mechanism and of the slewing gear, the control of the hoisting gear in accordance with the invention can also be combined with load swing damping which damps spherical sway movements of the load. The present method can, however, also be used without load swing damping to damp natural oscillations of the system comprising hoist winch, rope and load which extend in the rope direction, and in particular oscillations of the load in the hoisting direction.

The present invention furthermore includes a crane control for the carrying out of the method as it was presented above. The crane control in this respect advantageously has a control program via which a method is implemented such as it was presented above.

The present invention furthermore includes a crane having a control unit which has a control program via which a method is implemented such as it was presented above. The same advantages such as were already presented above with respect to the method obviously result from the crane control or the crane.

In this respect, the crane advantageously has a slewing gear, a luffing mechanism and/or a hoisting gear. The crane in this respect advantageously has a boom which is pivotally connected to the crane in a manner luffable about a horizontal luffing axis and is moved via a luffing cylinder. Alternatively, a retraction mechanism can be used as the luffing mechanism. The crane furthermore advantageously has a tower which is rotatable about a vertical axis of rotation. The boom is in this respect advantageously pivotally connected to the tower. Further advantageously, the hoist rope in this respect runs from the hoisting gear over one or more pulley blocks to the load. Further advantageously, the crane has an undercarriage with a traveling gear.

BRIEF DESCRIPTION OF THE DRAWINGS

The present invention will now be described in more detail with reference to an embodiment and to drawings. There are shown.

DESCRIPTION OF THE PREFERRED EMBODIMENTS

Figure 1:
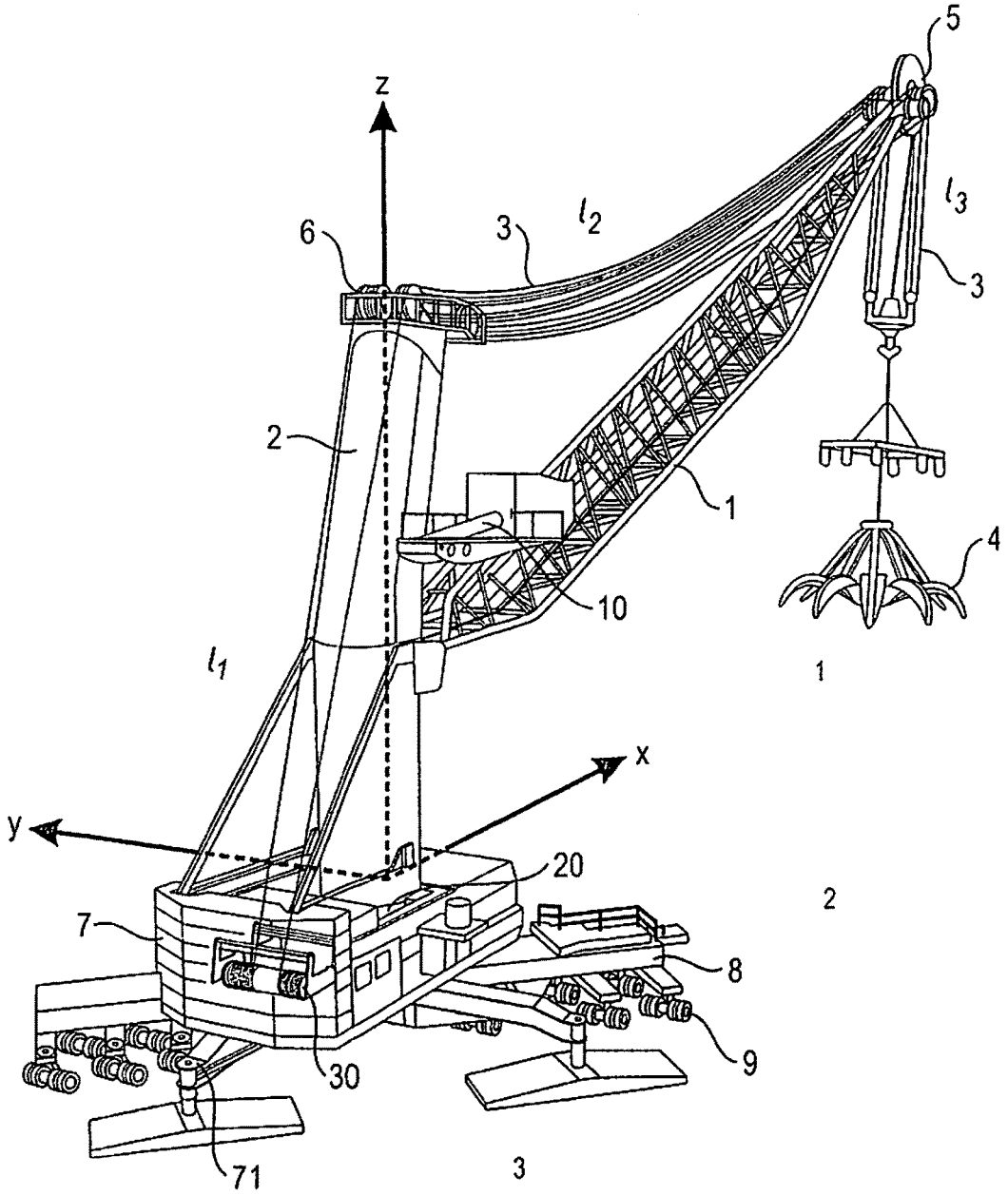
FIG. 1: an embodiment of a crane in accordance with the invention.

An embodiment of the crane in accordance with the invention is shown in FIG. 1 in which an embodiment of a control method in accordance with the invention is implemented. In this respect, the crane has a boom 1 which is pivotally connected to the tower 2 in a manner luffable about a horizontal luffing axis. In the embodiment, a hydraulic cylinder 10 is provided for the luffing up and down of the boom 1 in the luffing plane and is pivotally connected between the boom 1 and the tower 2.

Figure 2:
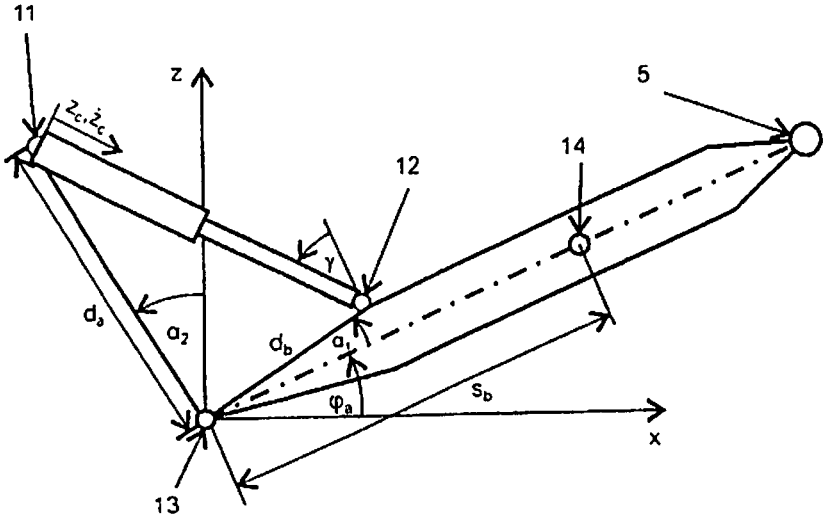
FIG. 2: a unifilar diagram of the kinematics of the pivotal connection of the boom of a crane boom in accordance with the invention.

The kinematics of the pivotal connection of the boom 1 to the tower 2 are in this respect shown in more detail in FIG. 2. The boom 1 is pivotally connected to a pivotal connection point 13 at the tower 2 in a manner luffable about a horizontal luffing axis. The hydraulic cylinder 10 is arranged via a pivotal connection point 11 to the tower 2 and via a pivotal connection point 12 to the boom 1 between said tower and boom. The boom 1 can thus be luffed up and down in the luffing plane by a length change of the hydraulic cylinder 10. The angles and lengths relevant for this purpose are drawn in FIG. 2.

As shown in FIG. 1, the tower 2 is arranged rotatable about a vertical axis of rotation z, with the rotational movement being generated by a slewing gear 20. The tower 2 is for this purpose arranged on a superstructure 7 which can be rotated with respect to an undercarriage 8 via the slewing gear. The embodiment is in this respect a mobile crane for which the undercarriage 8 is equipped with a traveling gear 9. The crane can then be supported via support elements 71 at the hoist position.

The lifting of the load in this respect takes place via a hoist rope 3 at which a load receiving element 4, in this case a gripper, is arranged. The hoist rope 3 is in this respect guided via pulley blocks at the boom tip 5 as well as at the tower tip 6 to the hoisting gear 30 at the superstructure and the length of the hoist rope can be changed via it.

The inventors of the present invention have now recognized that with known methods for the control of the drive of the crane, natural oscillations of the crane structure and of the drives can arise which can exert substantial pressure thereon.

In the control of the stewing gear and/or of the luffing mechanism in accordance with the present invention, a desired movement of the boom tip therefore serves as an input value on the basis of which a control parameter for the control of the drives is calculated. If the drive is a hydraulic drive, the control parameter can in this respect, for example, include the hydraulic pressure or the hydraulic flow for the hydraulic drive. In accordance with the invention, in this respect, the internal oscillation dynamics of the drives or of the crane structure are taken into account in the calculation of the control parameter. Natural oscillations of the crane structure and of the drives can hereby be avoided.

On the control of the hoisting gear, in contrast, oscillations of the load due to the stretchability of the load rope form a decisive factor in the natural oscillations of the crane structure. The total system comprising the hoisting gear 30 and the rope 3 is therefore used here as the drive system for the calculation of the control of the hoisting gear. In this respect, the desired hoist position of the load serves as the input value on the basis of which the control parameter for the control of the hoisting gear is calculated. In this respect, the oscillation dynamics of the system comprising hoisting gear, rope and load is taken into account in the calculation of the control parameter to avoid natural oscillations of the system. The stretchability of the hoist rope is in particular taken into account on the calculation of the control parameter to damp the stretch oscillations of the rope. Unlike in known load swing damping system, no spherical sway oscillations of the load are therefore taken into account here, but rather the oscillation of the load in the rope direction through the stretching or contraction of the hoist rope. Furthermore, the oscillation of the system comprising hoisting gear 30 and rope 3 due to the compressibility of the hydraulic fluid can also be taken into account in the hoisting gear 30.

The present invention thus enables a substantial structural saving of the crane, which in turn saves costs in the maintenance and in the construction. In this respect, loads on the crane structure which can, in contrast, even be amplified in known methods for the spherical swing damping of the load can be avoided by the taking into account of the oscillation dynamics of the drives of the crane, that is, of the slewing gear, of the luffing mechanism and of the system comprising hoisting gear and rope.

The control of the drives takes place in this respect on the basis of a physical model which describes the movement of the crane tip or of the load in dependence on the control parameter, with the model taking the internal oscillation dynamics of the respective drives into account.

Figure 3:
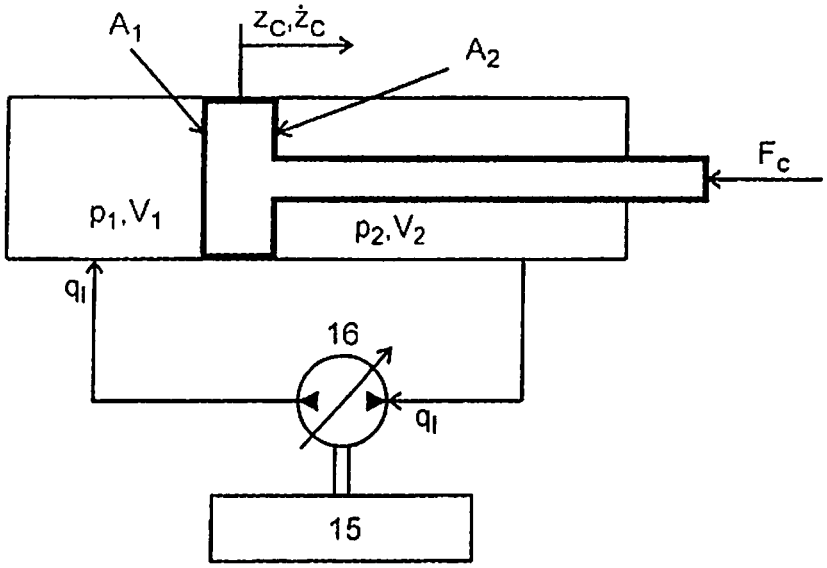
FIG. 3: a unifilar diagram of the hydraulics of the luffing cylinder of a crane in accordance with the invention.

In this respect, a unifilar diagram of the hydraulics of the luffing mechanism is shown in FIG. 3. In this respect, a diesel engine 15 is e.g. provided which drives a variable delivery pump 16. This variable delivery pump 16 charges the two hydraulic chambers of the luffing cylinder 10 with hydraulic fluid. Alternatively, an electric motor could also be used for the drive of the variable delivery pump 16.

Figure 4:
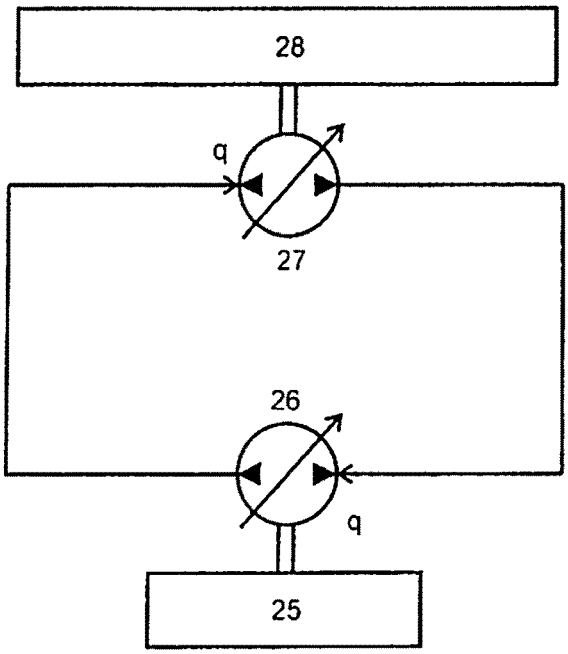
FIG. 4: a unifilar diagram of the hydraulics of the slewing gear and of the hoisting gear of a crane in accordance with the invention.

FIG. 4 shows a schematic diagram of the hydraulics of the slewing gear and of the hoisting gear. A diesel engine or electric motor 25 is e.g. again provided here which drives a variable delivery pump 26. This variable delivery pump 26 forms a hydraulic circuit with a hydraulic motor 27 and drives it. The hydraulic motor 27 is in this respect also made as a variable capacity motor. Alternatively, a fixed displacement motor could also be used. The slewing gear or the hoist winch is then driven via the hydraulic motor 27.

Figure 5:
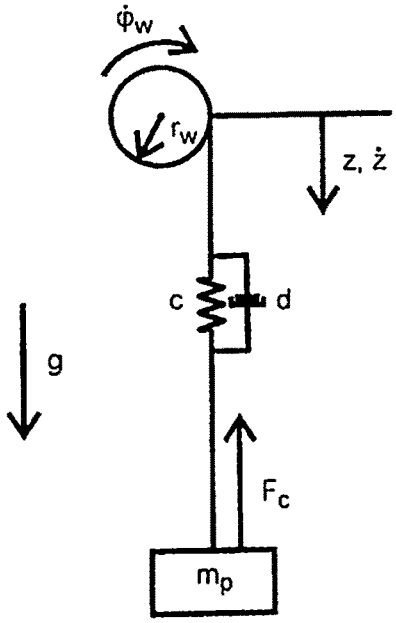
FIG. 5: a unifilar diagram of the physical model which is used for the description of the dynamics of the load rope.

The physical model will now be presented in more detail in FIG. 5 by which the dynamics of the load rope 3 and of the load is described. The system comprising the load rope and the load is in this respect considered as a damped spring pendulum system, having a spring constant C and a damping constant D. In this respect, the length of the hoist rope L is taken into the spring constant C and is either determined with reference to measured values or is calculated on the basis of the control of the hoist winch. The mass M of the load which is measured via a load mass sensor is furthermore taken into the control.

In the following, an embodiment of a method for the control of the respective gearing or mechanisms will be presented in more detail:

1 Introduction

The embodiment shown in FIG. 1 is a mobile harbor crane. The boom, the tower and the hoist winch are set into motion via corresponding drives here. The hydraulic drives setting the boom, the tower and the hoist winch of the crane into movement generate natural oscillations due to the inherent dynamics of the hydraulic systems. The resulting force oscillations influence the long-term fatigue of the cylinder and of the ropes and thus reduce the service life of the total crane structure, which results in increased maintenance. In accordance with the invention, a control rule is therefore provided which suppresses the natural oscillations caused by luffing, slewing and hoisting movements of the crane and thereby reduces the load cycles within the Wöhler diagram. A reduction in the load cycles logically increases the service life of the crane structure.

Feedbacks should be avoided on the derivation of the control rule since they require sensor signals which have to satisfy specific safety demands in industrial applications and thereby lead to higher costs.

The design of a pure pre-control without feedback is therefore necessary. A flatness-based pre-control which inverts the system dynamics will be derived within this discourse for the luffing mechanism, slewing gear and hoisting gear.

2 Luffing Mechanism

The boom of the crane is set into motion by a hydraulic luffing cylinder, as is shown in FIG. 1. The dynamic model and the control rule for the luffing cylinder will be derived in the following section.

2.1 Dynamic Model

A dynamic model of the hydraulically driven boom will be derived in the following. The boom is shown schematically in FIG. 2 together with the hydraulic cylinder. The movement of the boom is described by the luffing angle $\varphi_a$ and the angular speed $\dot{\varphi}_a$. The movement of the hydraulic cylinder is described by the cylinder position $z_c$, which is defined as the spacing between the cylinder connection to the tower and the cylinder connection to the boom, and by the cylinder speed $\dot{z}_c$. The geometrical dependencies between the movement of the boom and the cylinder are given by the geometrical constants $d_a$, $d_b$, $\alpha_1$ and $\alpha_2$ and by the cosine rule. The following applies to the cylinder position:

$$z_c(\varphi_a) = \sqrt{d_a^2 + d_b^2 - 2d_a d_b \cos\left(\frac{\pi}{2} + \alpha_2 - \alpha_1 - \varphi_a\right)} \tag{1}$$

and to the cylinder speed $$\dot{z}_c(\varphi_a, \dot{\varphi}_a) = \frac{\partial z_c(\varphi_a)}{\partial \varphi_a}\frac{\partial \varphi_a}{\partial t} = -d_a d_b \sin\left(\frac{\pi}{2} + \alpha_2 - \alpha_1 - \varphi_a\right)\frac{\dot{\varphi}_a}{z_c(\varphi_a)} \tag{2}$$

Since the geometrical angle $\alpha_1$ is small, it is neglected in the derivation of the dynamic model. The Newton-Euler method produces the movement equation for the boom:

$$J_b\ddot{\varphi}_a = (F_c + d_c\dot{z}_c(\varphi_a, \dot{\varphi}_a))d_b\cos(\gamma) - m_b g s_b \cos(\varphi_a),$$
$$\varphi_a(0) = \varphi_{a0}, \dot{\varphi}_a(0) = 0 \tag{3}$$

where $J_b$ and $m_b$ are the moment of inertia and the mass of the boom respectively, $s_b$ is the spacing between the boom connection to the tower and the center of mass of the boom, g is the gravitational constant and $F_c$ and $d_c$ are the cylinder force and the damping coefficient of the cylinder respectively. It is assumed that no payload is attached to the end of the boom. The term cos(γ) in (3) is given by the sine rule:

$$\cos(\gamma) = \sin\left(\frac{\pi}{2} - \gamma\right) = \frac{d_a}{z_c(\varphi_a)}\sin\left(\frac{\pi}{2} + \alpha_2 - \varphi_a\right) \tag{4}$$

where $\alpha_1$ is neglected.

The hydraulic circuit of the luffing cylinder basically comprises a variable delivery pump and the hydraulic cylinder itself, as is shown in FIG. 3. It follows for the cylinder force:

$$F_c = p_2 A_2 - p_1 A_1 \tag{5}$$

where $A_1$ and $A_2$ are the effective areas in each chamber. The pressures $p_1$ and $p_2$ are described by the pressure build-up equation under the assumption that no internal or external leaks occur. It thus applies:

$$\dot{p}_1 = \frac{1}{\beta V_1(z_c)}(q_l - A_1\dot{z}_c),\ p_1(0) = p_{10} \tag{6}$$

$$\dot{p}_2 = \frac{1}{\beta V_2(z_c)}(-q_l + A_2\dot{z}_c),\ p_2(0) = p_{20} \tag{7}$$

where β is the compressibility of the oil and the chamber volumes are given by $$V_1(z_c) = V_{min} + A_1(z_c(\varphi_a) - z_{c,min}) \tag{8}$$

$$V_2(z_c) = V_{min} + V_{2,max} - A_2(z_c(\varphi_a) - z_{c,min}) \tag{9}$$

where $V_{min}$ is the minimum volume in each chamber and $V_{2,max}$ and $z_{c,min}$ are the maximum volume in the second chamber and the minimum cylinder position respectively which is achieved when $\varphi_a = \varphi_{a,max}$. The oil throughput $q_l$ is preset by the pump angle and is given by:

$$q_l = K_l u_l \tag{10}$$

where $u_l$ and $K_l$ are the control power for the pump angle and the proportionality factor.

2.2 Control Rule

The flatness-based pre-control in accordance with the invention utilizes the differential flatness of the system to invert the control dynamics. The dynamic model derived in section 2.1. must be transformed into the state space for the derivation of such a control rule. By introducing the state vector $x = [\varphi_a, \dot{\varphi}_a, F_c]^T$ the dynamic model (3), (5), (6) and (7) can be described as a system of first order differential equations which is given by:

$$\dot{x} = f(x) + g(x)u,\ y = h(x),\ x(0) = x_0,\ t \geq 0 \tag{11}$$

where $$f(x) = \begin{bmatrix} x_2 \\ \dfrac{(x_3 + d_c\dot{z}_c)d_b\cos(\gamma) - m_b g s_b \cos(x_1)}{J_b} \\ \left(\dfrac{A_2^2}{\beta V_2(z_c)} + \dfrac{A_1^2}{\beta V_1(z_c)}\right)\dot{z}_c \end{bmatrix} \tag{12}$$

$$g(x) = \begin{bmatrix} 0 \\ 0 \\ -\dfrac{K_l A_2}{\beta V_2(z_c)} - \dfrac{K_l A_1}{\beta V_1(z_c)} \end{bmatrix} \tag{13}$$

$$h(x) = x_1 \tag{14}$$

and $z_c = z_c(x_l)$, $\dot{z}_c = \dot{z}_c(x_1, x_2)$, $\gamma = \gamma(x_l)$ and $u = u_l$.

The relative degree r with respect to the system output must be equal to the order n of the system for the design of a flatness-based pre-control. The relative degree of the observed system (11) will therefore be examined in the following. The relative degree with respect to the system output is fixed by the following conditions;

$$L_g L_f^i h(x) = 0\ \forall i = 0, \ldots, r-2$$

$$L_g L_f^{r-1} h(x) \neq 0\ \forall x \in R^n \tag{15}$$

The operators $L_f$ and $L_g$ represent the Lie derivatives along the vector fields f and g respectively. The use of (15) produces r=n=3 so that the system (11) with (12), (13) and (14) is flat and a flatness-based pre-control can be designed.

The output of the system (14) and its time derivatives are used to invert the system dynamics. The derivatives are formed by the Lie derivatives so that:

$$y = h(x) = x_1 \tag{16}$$

$$\dot{y} = \frac{\partial h(x)}{\partial x}\frac{\partial x}{\partial t} = L_f h(x) + \underbrace{L_g h(x)}_{=0} u = x_2 \tag{17}$$

$$\ddot{y} = \frac{\partial L_f h(x)}{\partial x}\frac{\partial x}{\partial t} = L_f^2 h(x) + \underbrace{L_g L_f h(x)}_{=0} u = f_2(x) \tag{18}$$

-continued $$\dddot{y} = \frac{\partial L_f^2 h(x)}{\partial x}\frac{\partial x}{\partial t} = L_f^3 h(x) + L_g L_f^2 h(x)u = \frac{x_2}{J_b} m_b g s_b \sin(x_1) - \frac{x_2}{J_b}(x_3 + d_c \dot{z}_c(x_1, x_2)) d_b \sin(\gamma(x_1))\gamma'(x_1) + \frac{x_2}{J_b} d_c d_b \cos(\gamma(x_1)) \frac{\partial \dot{z}_c(x_1, x_2)}{\partial x_1} + \frac{f_2(x)}{J_b} d_c d_b \cos(\gamma(x_1)) \frac{\partial \dot{z}_c(x_1, x_2)}{\partial x_2} + \frac{f_3(x) + g_3(x)u}{J_b} d_b \cos(\gamma(x_1)) \tag{19}$$

apply, where $f_i(x)$ and $g_i(x)$ are the ith series of the vector field f(x) and g(x) which are given by (12) and (13). The states in dependence on the system output and its derivatives follow from (16), (17) and (18) and can be written as:

$$x_1 = y \tag{20}$$

$$x_2 = \dot{y} \tag{21}$$

$$x_3 = \frac{J_b \ddot{y} + m_b g s_b \cos(\gamma(y))}{d_b \cos(\gamma(y))} - d_c \dot{z}_c(y, \dot{y}) \tag{22}$$

The resolving of (19) after the system input u produces, when using (20), (21) and (22), the control rule for the flatness-based pre-control for the luffing cylinder $$u_l = f(y, \dot{y}, \ddot{y}, \dddot{y}) \tag{23}$$

which inverts the system dynamics. The reference signals y and the corresponding derivatives are obtained by a numerical trajectory generation from the hand lever signals of the crane operator or from the control signals of an automation system.

Since the control current $u_l$ presets the cylinder speed (see 10)), the trajectories are originally planned in cylinder coordinates for $z_c$, $\dot{z}_c$, $\ddot{z}_c$ and $\dddot{z}_c$. Subsequently, the trajectories obtained in this manner are transformed into $\varphi_a$ coordinates and the actual control current is calculated.

3 Slewing Gear

The rotational movement of the tower takes place by a hydraulic rotary motor. The dynamic model and the control rule for the slewing gear are derived within the following sections.

3.1 Dynamic Model

The movement of the tower about the z axis (see FIG. 1) is described by the swing angle $\varphi_s$ and the angle speed $\dot{\varphi}_s$. The use of the Newton-Euler method produces the movement equation for the hydraulically driven tower:

$$(J_l + i_s^2 J_m)\ddot{\varphi}_s = i_s D_M \Delta p_s,\ \varphi_s(0) = \varphi_{s0},\ \dot{\varphi}_s(0) = 0 \tag{24}$$

where $J_l$ and $J_m$ are the inertia moment of the tower and of the motor respectively, $i_s$ is the gear ratio of the slewing gear, $\Delta p_s$ is the pressure difference between the pressure chambers of the motor and $D_m$ is the displacement of the hydraulic motor. The moment of inertia of the tower $J_l$ includes the moment of inertia of the tower itself, of the boom, of the attached payload of the tower about the z axis of the tower (see FIG. 1). The hydraulic circuit of the slewing gear basically comprises a variable delivery pump and the hydraulic motor itself, as is shown in FIG. 4. The pressure difference between the two pressure chambers of the motor is described by the pressure build-up equation under the assumption that there are no internal or external leaks. In addition, the small volume change due to the motor angle $\varphi_m$ is neglected in the following. The volume in the two pressure chambers is thus assumed to be constant and is designated by $V_m$. With the help of these assumptions, the pressure build-up equation can be described as $$\Delta \dot{p}_s = \frac{4}{V_m \beta}(q_s - D_m i_s \dot{\varphi}_s),\ \Delta p_s(0) = \Delta p_{s0} \tag{25}$$

where β is the compressibility of the oil. The oil throughput $q_s$ is preset by the pump angle and is given by:

$$q_s = K_s u_s \tag{26}$$

where $u_s$ and $K_s$ are the control current of the pump angle and the proportionality factor respectively.

3.2 Control Rule

The dynamic model for the slewing gear is transformed into the state space in the following and a flatness-based pre-control is designed. The state vector for the slewing gear is defined as $x = [\varphi_s, \dot{\varphi}_s\ \Delta p_s]^T$. With the help of the state vector, the dynamic model comprising (24), (25) and (26) is described as a system of first order differential equations which is given by (11) where:

$$f(x) = \begin{bmatrix} x_2 \\ \frac{i_s D_m x_3}{J_t + i_s^2 J_m} \\ \frac{-4 D_m i_s x_2}{V_m \beta} \end{bmatrix} \tag{27}$$

$$g(x) = \begin{bmatrix} 0 \\ 0 \\ \frac{4K_s}{V_m \beta} \end{bmatrix} \tag{28}$$

$$h(x) = x_1 \quad \text{and } u = u_s. \tag{29}$$

In turn, the relative degree r with respect to the system output must be the same as the order n of the system. The use of (15) produces r=n=3 so that the system (11) with (27), (28) and (29) is flat and a flatness-based pre-control can be designed.

The output of the system (29) and its time derivatives are used to invert the system dynamics. The derivatives are given by the Lie derivatives, that is $$y = h(x) = x_1 \tag{30}$$

$$\dot{y} = \frac{\partial h(x)}{\partial x}\frac{\partial x}{\partial t} = L_f h(x) + \underbrace{L_g h(x)}_{=0} u = x_2 \tag{31}$$

$$\ddot{y} = \frac{\partial L_f h(x)}{\partial x}\frac{\partial x}{\partial t} = L_f^2 h(x) + \underbrace{L_g L_f h(x)}_{=0} u = \frac{i_s D_m x_3}{J_t + i_s^2 J_m} \tag{32}$$

$$\dddot{y} = \frac{\partial L_f^2 h(x)}{\partial x}\frac{\partial x}{\partial t} = L_f^3 h(x) + L_g L_f^2 h(x)u = \frac{-4 D_m i_s x_2}{V_m \beta} + \frac{4K_s}{V_m \beta} u \tag{33}$$

The states in dependence on the system output and its derivatives follow from (30), (31) and (32) and can be written as:

$$x_1 = y \tag{34}$$

$$x_2 = \dot{y} \tag{35}$$

$$x_3 = \frac{J_t + i_s^2 J_m}{i_s D_m}\ddot{y} \tag{36}$$

The resolving of (33) after the system input u produces, when using (34), (35) and (36), the control rule for the flatness-based pre-control for the slewing gear $$u_s = f(y, \dot{y}, \ddot{y}, \dddot{y}) \tag{37}$$

which inverts the system dynamics. The reference signal y and its derivatives are obtained by a numerical trajectory generation from the hand lever signal of the crane operator.

4 Hoist Winch

The hoist winch of the crane is driven by a hydraulically operated rotary motor. The dynamic model and the control rule for the hoist winch will be derived in the following section.

4.1 Dynamic Model

Since the hoisting force is directly influenced by the payload movement, the dynamics of the payload movement must be taken into account. As is shown in FIG. 1, the payload having the mass $m_p$ is attached to a hook and can be raised or lowered by the crane by means of a rope of the length $l_r$. The rope is deflected by a deflection pulley at the boom tip and at the tower. The rope is, however, not deflected directly from the end of the boom to the hoist winch, but rather from the end of the boom to the tower, from there back to the end of the boom and then via the tower to the hoist winch (see FIG. 1). The total rope length is thus given by:

$$l_r = l_1 + 3l_2 + l_3 \tag{38}$$

where $l_1$, $l_2$ and $l_3$ are the part lengths from the hoist winch to the tower, from the tower to the end of the boom and from the end of the boom to the hook. The hoist system of the crane, which comprises the hoist winch, the rope and the payload, is considered in the following as a spring-mass damper system and is shown in FIG. 5. The use of the Newton-Euler method produces the movement equation for the payload:

$$m_p \ddot{z}_p = m_p g - \underbrace{(c(z_p - r_w\varphi_w) + d(\dot{z}_p - r_w\dot{\varphi}_w))}_{F_s}, \quad z_p(0) = z_{p0},\ \dot{z}_p(0) = 0 \tag{39}$$

with the gravitational constant g, the spring constant c, the damping constant d, the radius of the hoist winch $r_w$, the angle $\varphi_w$ of the hoist winch, the angle speed $\dot{\varphi}_w$, the payload position $z_p$, the payload speed $\dot{z}_p$ and the payload acceleration $\ddot{z}_p$. The rope length $l_r$ is given by $$l_r(t) = r_w\varphi_w(t) \tag{40}$$

with $$\varphi_w(0) = \varphi_{w0} = \frac{l_1(0) + 3l_2(0) + l_3(0)}{r_w} \tag{41}$$

The spring constant $c_r$ of a rope of the length $l_r$ is given by Hooke's Law and can be written as $$c_r = \frac{E_r A_r}{l_r} \tag{42}$$

where $E_r$ and $A_r$ are the module of elasticity and the sectional surface of the rope respectively. The crane has $n_r$ parallel ropes (see FIG. 1) so that the spring constant of the hoisting gear of the crane is given by:

$$c = n_r c_r \tag{43}$$

The damping constant d can be given with the help of Lehr's damping ratio D $$d = 2D\sqrt{cm_p} \tag{44}$$

The differential equation for the rotational movement of the hoist winch results in accordance with the Newton-Euler method as $$(J_w + i_w^2 J_m)\ddot{\varphi}_w = i_w D_m \Delta p_w + r_w F_s,\ \varphi_w(0) = \varphi_{w0},\ \dot{\varphi}_w(0) = 0 \tag{45}$$

where $J_w$ and $J_m$ are the moment of inertia of the winch or of the motor respectively, $i_w$ is the gear ratio between the motor and the winch, $\Delta p_w$ is the pressure difference between the high-pressure chamber and the lower-pressure chamber of the motor respectively, $D_m$ is the displacement of the hydraulic motor and $F_s$ is the spring force given in (39). The initial condition $\varphi_{w0}$ for the angle of the hoist winch is given by (41). The hydraulic circuit for the hoist winch is basically the same as for the slewing gear and is shown in FIG. 4. The pressure difference $\Delta p_w$ can thus be written, analog to the slewing gear (see (25)), as $$\Delta\dot{p}_w = \frac{4}{V_m\beta}(q_w - D_m i_w \dot{\varphi}_w),\ \Delta p_w(0) = \Delta p_{w0} \tag{46}$$

The oil throughput $q_w$ is preset by the pump angle and is given by $$q_w = K_w u_w \tag{47}$$

where $u_w$ and $K_w$ are the control current of the pump angle and the proportionality factor respectively.

4.2 Control Rule

The dynamic model for the hoist winch is transformed into the state space in the following to design a flatness-based pre-control. The derivation of the control rule neglects the damping, D=0 therefore applies. The state vector of the hoisting gear of the crane is defined as $x = [\varphi_w, \dot{\varphi}_w, z_p, \dot{z}_p, \Delta p_w]^T$. The dynamic model comprises (39, (40), (43), (45), (46) and (47) can thus be given as a system of first order differential equations which is given by (11), with $$f(x) = \begin{bmatrix} x_2 \\ \frac{1}{J_w + i_w^2 J_m}\left(i_w D_m x_5 + r_w\left(\frac{E_r A_r n_r}{r_w x_1}(x_3 - r_w x_1)\right)\right) \\ x_4 \\ g - \frac{E_r A_r n_r}{r_w x_1 m_p}(x_3 - r_w x_1) \\ \frac{-4 D_m i_w x_2}{V_m \beta} \end{bmatrix} \tag{48}$$

-continued $$g(x) = \begin{bmatrix} 0 \\ 0 \\ 0 \\ 0 \\ \frac{4K_w}{V_m\beta} \end{bmatrix} \tag{49}$$

$$h(x) = x_3 \tag{50}$$

and $u = u_w$.

In turn, the relative degree r with respect to the system output must be the same as the order n of the system. The use of (15) produces r=n=5 so that the system (11) with (48), (49) and (50) is flat and a flatness-based pre-control can be designed for D=0.

The system output (50) and its derivatives are used to invert the system dynamics as was done for the luffing mechanism and the slewing gear. The derivatives are given by the Lie derivatives, that is $$y = h(x) \tag{51}$$

$$\dot{y} = \frac{\partial h(x)}{\partial x}\frac{\partial x}{\partial t} = L_f h(x) + \underbrace{L_g h(x)u}_{=0} \tag{52}$$

$$\ddot{y} = \frac{\partial L_f h(x)}{\partial x}\frac{\partial x}{\partial t} = L_f^2 h(x) + \underbrace{L_g L_f h(x)u}_{=0} \tag{53}$$

$$\dddot{y} = \frac{\partial L_f^2 h(x)}{\partial x}\frac{\partial x}{\partial t} = L_f^3 h(x) + \underbrace{L_g L_f^2 h(x)u}_{=0} \tag{54}$$

$$\overset{(4)}{y} = \frac{\partial L_f^3 h(x)}{\partial x}\frac{\partial x}{\partial t} = L_f^4 h(x) + \underbrace{L_g L_f^3 h(x)u}_{=0} \tag{55}$$

$$\overset{(5)}{y} = \frac{\partial L_f^4 h(x)}{\partial x}\frac{\partial x}{\partial t} = L_f^5 h(x) + L_g L_f^4 h(x)u \tag{56}$$

The states in dependence on the system output and its derivatives follow from (51), (52), (53), (54) and (55) and can be written as:

$$x_1 = \frac{A_r E_r n_r y}{r_w(g m_p + A_r E_r n_r - m_p \ddot{y})} \tag{57}$$

$$x_2 = x_2(y, \dot{y}, \ddot{y}, \dddot{y}) \tag{58}$$

$$x_3 = y \tag{59}$$

-continued $$x_4 = \ddot{y} \tag{60}$$

$$x_5 = x_5\left(y, \dot{y}, \ddot{y}, \dddot{y}, \overset{(4)}{y}\right) \tag{61}$$

The resolving of (56) after the system input u produces, when using (57), (58), (59), (60) and (61) the control rule for the flatness-based pre-control for the hoisting gear $$u_w = f\left(y, \dot{y}, \ddot{y}, \dddot{y}, \overset{(4)}{y}, \overset{(5)}{y}\right) \tag{62}$$

which inverts the system dynamics. The reference signal y and its derivatives are obtained by a numerical trajectory generation from the hand lever signal of the crane operator.

The invention claimed is:

1. A method for the control of a hoisting gear of a crane, the crane including a rope and a load attached thereto, comprising:

receiving at a control unit a desired hoisting movement of a load;

calculating at the control unit the oscillation dynamics of the hoisting gear;

calculating at the control unit the oscillation dynamics of the rope;

calculating at the control unit the oscillation dynamics of the load in the direction of the rope; and calculating by the control unit a control parameter to reduce natural oscillations for the control of the drive based on the desired movement of the load, the oscillation dynamics of the hoisting gear, the oscillation dynamics of the rope and the oscillation dynamics of the load in the direction of the rope.

2. A method in accordance with claim 1, wherein the oscillation dynamics due to the stretchability of the hoist rope are taken into account in the calculation of the control parameter.

3. A method in accordance with claim 1, wherein the hoisting gear is driven hydraulically and the oscillation dynamics due to the compressibility of the hydraulic fluid are taken into account in the calculation of the control parameter.

4. A method in accordance with claim 1, wherein the variable rope length and/or the weight of the load suspended at the load rope is/are taken into the calculation of the control parameter.

5. A method in accordance with claim 1, wherein the control of the hoisting gear is based on a physical model of the crane which describes the hoisting movement of the load in dependence on the control parameter of the hoisting gear, and the control of the hoisting gear is advantageously based on the inversion of the physical model.

* * * * *